United States Patent [19]

Chan

[11] 4,065,125

[45] Dec. 27, 1977

[54] MULTIPURPOSE GAME APPARATUS

[75] Inventor: Peter Chan, Toronto, Canada

[73] Assignee: The Raymond Lee Organization, Inc., New York, N.Y. ; a part interest

[21] Appl. No.: 792,329

[22] Filed: Apr. 29, 1977

[51] Int. Cl.[2] ..... A63D 15/04

[52] U.S. Cl. ..... 273/5 R; 273/136 K

[58] Field of Search ..... 273/5 R, 5 A, 5 B, 136 R, 273/136 K, 108, 136 A, 136 B, 136 C, 136 D, 136 E, 136 F, 136 G, 136 H, 136 GA, 136 GB, 136 K, 136 W, 136 Z, 5 C, 3 C, 3 A, 4 C, 4 R

[56] References Cited

U.S. PATENT DOCUMENTS

| | | | |
|---|---|---|---|
| 175,495 | 3/1876 | Pottin | 273/136 D |
| 1,127,594 | 2/1915 | Cooper | 273/136 GA |
| 1,410,171 | 3/1922 | Davis | 273/5 R |
| 1,422,397 | 7/1922 | Watson | 273/136 C |
| 1,546,831 | 7/1925 | Fritz | 273/136 E |
| 3,023,007 | 2/1962 | Lowery | 273/136 Z |

*Primary Examiner*—Richard C. Pinkham
*Assistant Examiner*—T. Brown
*Attorney, Agent, or Firm*—Daniel Jay Tick

[57] ABSTRACT

A table has a plurality of support legs releasably affixed thereto. Each of the legs has a support member for length adjustment thereof. A plurality of short legs, a fraction of the length of the support legs, are releasably coupled to the table top for supporting the table a short distance above a supporting surface when the support legs are removed. A checker board is marked on the top of the table and a fouls circle is provided at the center thereof. A plurality of pockets are formed in the surface of the table top, each at a corresponding corner thereof. Each of a plurality of cue sticks is releasably clamped to a corresponding one of the support legs.

1 Claim, 4 Drawing Figures

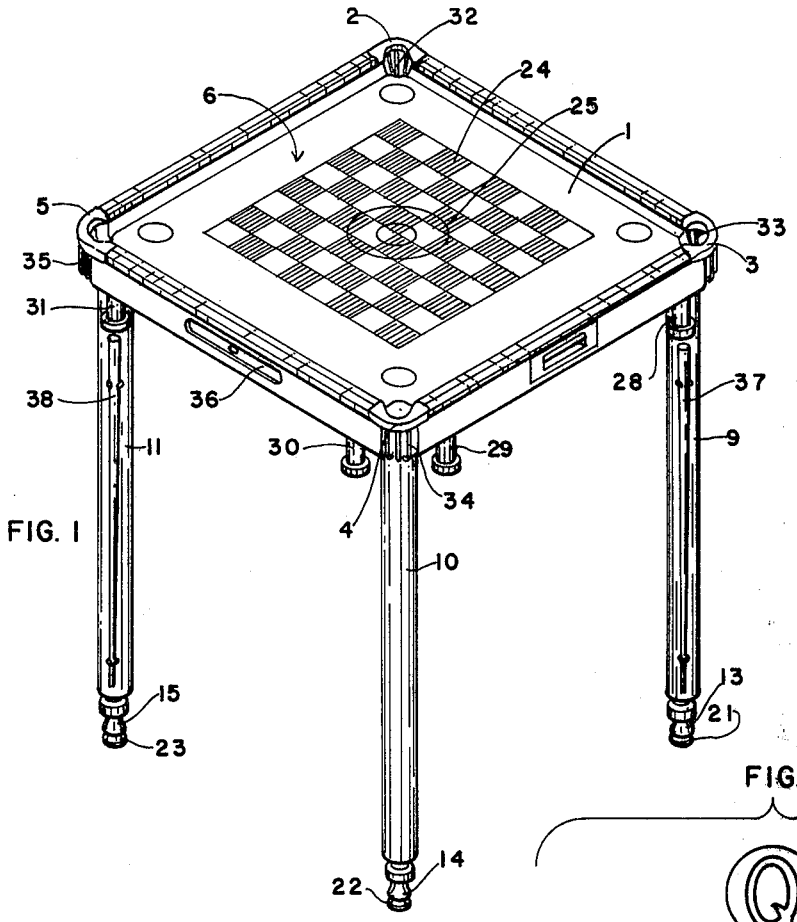
FIG. 1
FIG. 4
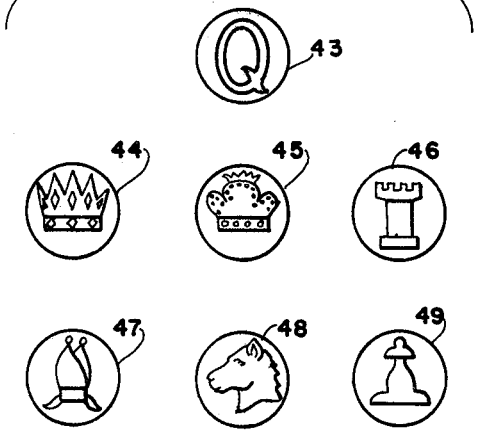
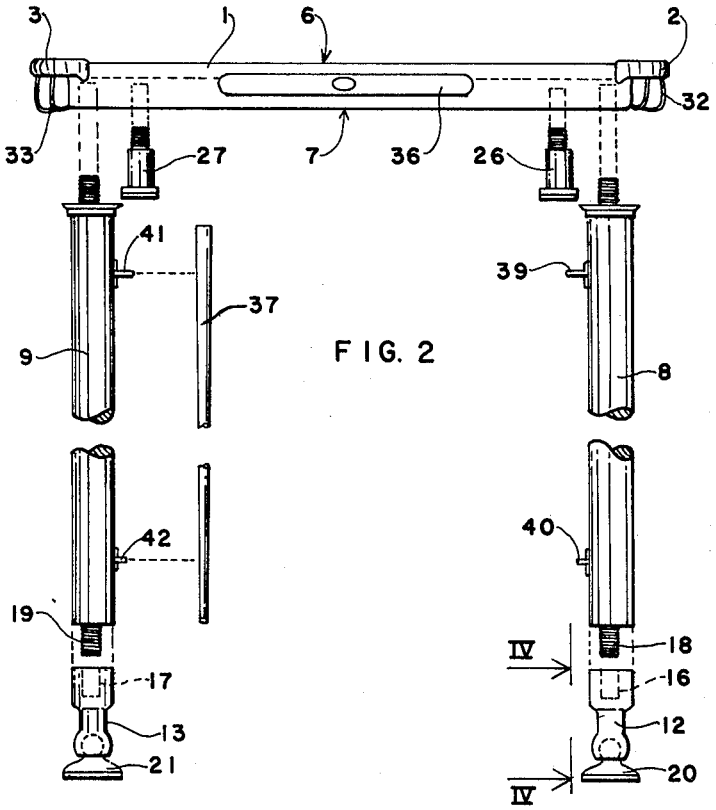
FIG. 2
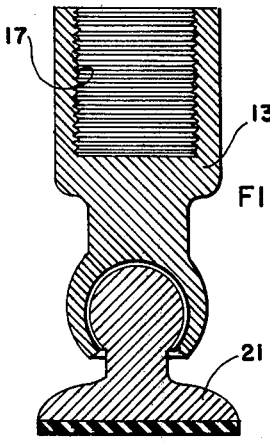
FIG. 3

MULTIPURPOSE GAME APPARATUS

BACKGROUND OF THE INVENTION

The present invention relates to multipurpose game apparatus. More particular, the invention relates to multipurpose game apparatus for billiards, snooker, checkers and chess.

Objects of the invention are to provide multipurpose game apparatus of simple structure, which is inexpensive in manufacture, used with facility and convenience, and functions efficiently, effectively and reliably to permit the playing of a number of games thereon, such games including billiards, snooker, checkers and chess.

BRIEF DESCRIPTION OF THE DRAWINGS

In order that the invention may be readily carried into effect, it will now be described with reference to the accompanying drawings, wherein:

FIG. 1 is a perspective view of an embodiment of the multipurpose game apparatus of the invention;

FIG. 2 is an exploded side view, on an enlarged scale, of the embodiment of FIG. 1;

FIG. 3 is a sectional view, on an enlarged scale, of an embodiment of a support member of a support leg of the multipurpose game apparatus of the invention; and FIG. 4 is a view of a plurality of chess disks of the multipurpose game apparatus of the invention.

DETAILED DESCRIPTION OF THE INVENTION

The multipurpose game apparatus of the invention is for billiards, snooker, checkers and chess.

The game apparatus of the invention comprises a table having a table top 1 of substantially square shape with four corners 2, 3, 4 and 5. The table top 1 has an oversurface 6 (FIGS. 1 and 2) and an undersurface 7 (FIG. 2). The table has a plurality of support legs 8, 9, 10 and 11 (FIGS. 1 and 2). Each of the support legs 8 to 11 is threadedly coupled to the table top 1 at the undersurface 7 thereof. The support legs 8, 9, 10 and 11 are provided at the corners 2, 3, 4 and 5, respectively, of the table top.

Each of the support legs has a support member universally mounted thereon for length adjustment and positioning at the bottom thereof. Thus, as shown in FIGS. 1 and 2, the support legs 8 to 11 have support members 12, 13, 14 and 15, respectively, universally mounted thereon. As shown in FIGS. 2 and 3, the support members 12 to 15 are threadedly coupled via internally threaded sockets 16, 17, and so on, to externally threaded projections 18, 19, and so on, extending coaxially from the bottoms of the support legs, so that the length of each of the support legs is adjustable thereby. Furthermore, the support members 12 to 15 have cap members 20, 21, 22 and 23, respectively, universally mounted thereon for universal positioning of the bottoms of said support legs.

The upper surface 6 of the table top 1 has a checker board 24 marked thereon and a fouls circle 25 at the center thereof, as shown in FIG. 1.

A plurality of short legs 26, 27, 28, 29, 30, 31, and so on (FIGS. 1 and 2) are provided. Each of the short legs 26 to 31, and so on, is a fraction of the length of the support legs 8 to 11. Each of the short legs 26 to 31, and so on, is threadedly coupled to the table top 1 at the undersurface 7 thereof in the area of a corresponding corner for supporting the table top a short distance above a supporting surface when the support legs are removed. Thus, the short leg 26 and another short leg, not shown in the FIGS., are provided at the corner 2 on both sides of the leg 8. The short legs 27 and 28 are provided at the corner 3 on both sides of the support leg 9. Short legs 29 and 30 are provided at the corner 4 on both sides of the support leg 10. The short leg 31 and another short leg, not shown in the FIGS., are provided at the corner 5 on both sides of the support leg 11.

Each of the support legs 8 to 11 and each of the short legs 26 to 31, and so on, is threadedly coupled to the table top 1 at the undersurface thereof.

A plurality of pockets are formed in the oversurface 6 of the table top 1. Thus, as shown in FIGS. 1 and 2, pockets 32, 33, 34 and 35 are formed in the oversurface 6 of the table top 1 at the corners 2, 3, 4 and 5, respectively.

As shown in FIGS. 1 and 2, a drawer 36 is slidably mounted on the undersurface 7 of the table top 1.

A plurality of cue sticks are provided. Clamps are provided on each of the support legs 8 to 11 for releasably supporting the cue sticks on the legs. Cue sticks 37 and 38 are shown in FIGS. 1 and 2. Clamps 39 and 40 are shown on the support leg 8 in FIG. 2. Clamps 41 and 42 are shown on the support leg 9 in FIG. 2.

A plurality of chess disks 43, 44, 45, 46, 47, 48 and 49 (FIG. 4) and checkers are removably stored in the drawer 36 so that users of the game apparatus of the invention may enjoy chess and checker games as well as billiards, snooker, and so on.

While the invention has been described by means of a specific example and in a specific embodiment, I do not wish to be limited thereto, for obvious modifications will occur to those skilled in the art without departing from the spirit and scope of the invention.

I claim:

1. Multipurpose game apparatus for billiards, snooker, checkers and chess, said game apparatus comprising a table having a table top of substantially square shape with four corners, an oversurface and an undersurface, and a plurality of support legs each threadedly coupled to the table top at the undersurface thereof with each support leg at a corresponding one of the corners, each of the support legs having a support member universally mounted thereon for length adjustment and positioning at the bottom thereof, the upper surface of the table top having a checker board marked thereon and a fouls circle at the center thereof;

a plurality of short legs a fraction of the length of the support legs each threadedly coupled to the table top at the undersurface thereof in the area of a corresponding corner for supporting the table top a short distance above a supporting surface when the support legs are removed;

a plurality of pockets formed in the oversurface of the table top each at a corresponding corner thereof;

a drawer slidably mounted on the undersurface of the table top;

a plurality of cue sticks;

clamp means on each of the support legs for releasably supporting the cue sticks on the legs; and a plurality of chess disks and checkers removably stored in the drawer.

* * * * *